US007187897B2

(12) United States Patent
Zess et al.

(10) Patent No.: US 7,187,897 B2
(45) Date of Patent: Mar. 6, 2007

(54) ROLL FUSER APPARATUS

(75) Inventors: Martin F. Zess, Churchville, NY (US); Mark S. Amico, Pittsford, NY (US)

(73) Assignee: Xerox Corporation, Stamford, CT (US)

( * ) Notice: Subject to any disclaimer, the term of this patent is extended or adjusted under 35 U.S.C. 154(b) by 175 days.

(21) Appl. No.: 11/065,989

(22) Filed: Feb. 25, 2005

(65) Prior Publication Data

US 2006/0193661 A1 Aug. 31, 2006

(51) Int. Cl.
*G03G 15/20* (2006.01)

(52) U.S. Cl. ..... 399/325; 399/326

(58) Field of Classification Search ..... 399/320, 399/324, 325, 326, 327
See application file for complete search history.

(56) References Cited

U.S. PATENT DOCUMENTS 5,504,566 A 4/1996 Chow et al.
5,839,015 A 11/1998 Faguy et al.
5,839,041 A 11/1998 Condello et al.
5,937,257 A * 8/1999 Condello et al. ..... 399/325

* cited by examiner

*Primary Examiner*—Hoang Ngo

(57) ABSTRACT

An improvement in a Release Agent Management system that alleviates the buildup of dirt, toner and paper debris on a wick in the system includes a metering roll, a supply of release agent material into which the wick is positioned and a pair of metering blades positioned on opposite sides of the metering roll before and after a nip formed between the metering roll and a donor roll. A first metering blade meters release agent material onto the metering roll and a second blade scrapes the surface of the metering roll to remove contaminants before the surface of the metering roll reaches the supply of release agent material in order to prevent contaminants from plugging the wick and thereby reduce the effectiveness of the wick.

20 Claims, 2 Drawing Sheets

ROLL FUSER APPARATUS

This disclosure relates in general to heat and pressure fusers for electrophotographic machines, and more particularly, to an improved Release Agent Management system therefor.

Typically, in an electrophotographic printing process of printers, such as, U.S. Pat. No. 5,839,015, shown as 8 in FIG. 1, which is incorporated herein by reference, a photoconductive member is charged to a substantially uniform potential so as to sensitize the surface thereof. The charged portion of the photoconductive member is exposed to selectively dissipate the charges thereon in the irradiated areas. This records an electrostatic latent image on the photoconductive member. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules either to a donor roll or to a latent image on the photoconductive member. The toner attracted to the donor roll is then deposited on latent electrostatic images on a charge retentive surface, which is usually a photoreceptor. The toner powder image is then transferred from the photoconductive member to a copy substrate. The toner particles are heated to permanently affix the powder image to the copy substrate.

In order to fix or fuse the toner material onto a support member permanently by heat, it is necessary to elevate the temperature of the toner material to a point at which constituents of the toner material coalesce and become tacky. This action causes the toner to flow, to some extent, onto fibers or pores of the support members or otherwise upon surfaces thereof. Thereafter, as the toner materials cool, solidification of the toner materials occurs causing the toner material to be bonded firmly to the support member.

One approach to thermal fusing of toner material images onto the supporting substrate has been to pass the substrate with the unfused toner images thereon between a pair or opposed roller members at least one of which is internally heated. During operation of a fusing system of this type, the support member, which the toner images are electrostatically adhered, is moved through the nip formed between the rolls with the toner images contacting the heated fuser roll to thereby effect heating of the toner images within the nip.

The heated fuser roll is usually the roll that contacts the toner images on a substrate, such as, plain paper. In any event, the roll contacting the toner images is usually provided with an abhesive material for preventing toner offset to the fuser member. These materials, which are commonly used for such purposes are PEA™, Viton™ and silicone rubber. All of these materials, in order to maintain their abhesive qualities, require release agents specific to the material.

Various methods are known for applying release agent materials to a fuser member such as a heated fuser roll. One such system comprises a Release Agent Management (RAM) system including a donor roll that contacts the fuser member to which the oil or release agent material is applied. The donor roll also contacts a metering roll, which conveys the oil from a wick positioned in a supply of oil to the donor roll. A blade member is provided for metering oil on the metering roll.

A problem with this type of RAM system pertains to debris, toner and dirt having a tendency to migrate from the front, of the paper to the fusing roll, to the donor roll, then to the metering roll and then to the fusing agent wick. Build up of the debris and dirt in the fusing agent wick will hinder the ability of the metering roll to transfer the release agent to the metering roll and then to the rest of the system. This will result in gradually higher fusing jams until the RAM system must be rebuilt to alleviate the problem. Also, the oil rate can be affected, impacting the release and print quality of the printing machine.

Attempts have been made heretofore to control dirt and debris in fusers, for example, U.S. Pat. No. 5,504,566 issued Apr. 2, 1996 to Chow et al. discloses a Release Agent Management system for applying silicone oil to a metering roll that utilizes a pair of metering blades to improve oil uniformity on the metering roll. With use of the two blades, streaks or localized areas of excess silicone oil, as a result of blade defects and/or dirt accumulation associated with the first blade, are metered or smoothed to a more uniform thickness by the second blade.

In U.S. Pat. No. 5,839,041 issued Nov. 17, 1998 to Condello et al., a RAM system is disclosed that includes a metering roll and a pair of metering blades. The pair of metering blades are positioned in contact with a metering roll at a location intermediate a nip formed through pressure contact of the metering roll with a donor roll, and a supply of release agent material, such that, as the metering roll is rotated in the imaging process direction release agent material is metered onto the metering roll and contaminants are prevented from getting deposited on the fuser roll. A second metering blade contacts the metering roll at a location that is intermediate the aforementioned nip and the supply of release agent, such that, when the metering roll is rotated in the direction opposite to the process direction, for jam clearance, excess release agent material and/or contaminants are prevented from being deposited on the fuser roll.

Obviously, there is still a need for a RAM system that answers the debris and dirt problem that is not too costly or too cumbersome and is easily retrofitted into current RAM systems.

Accordingly, an improved RAM system is disclosed that includes a cleaning blade installed on the backside of a metering roll, before the metering roll makes contact with a wick, such that the primary function of the metering roll is not interrupted. The cleaning blade is adapted to scrape debris and dirt off the metering roll into a collection member. The collection member keeps the debris and dirt from falling onto the wick and reducing its fusing agent transfer efficiency.

The foregoing and other features of the disclosure will be apparent and easily understood from a further reading of the specification, claims and by reference to the accompanying drawings in which like reference numerals refer to like elements and wherein:

Figure 1:
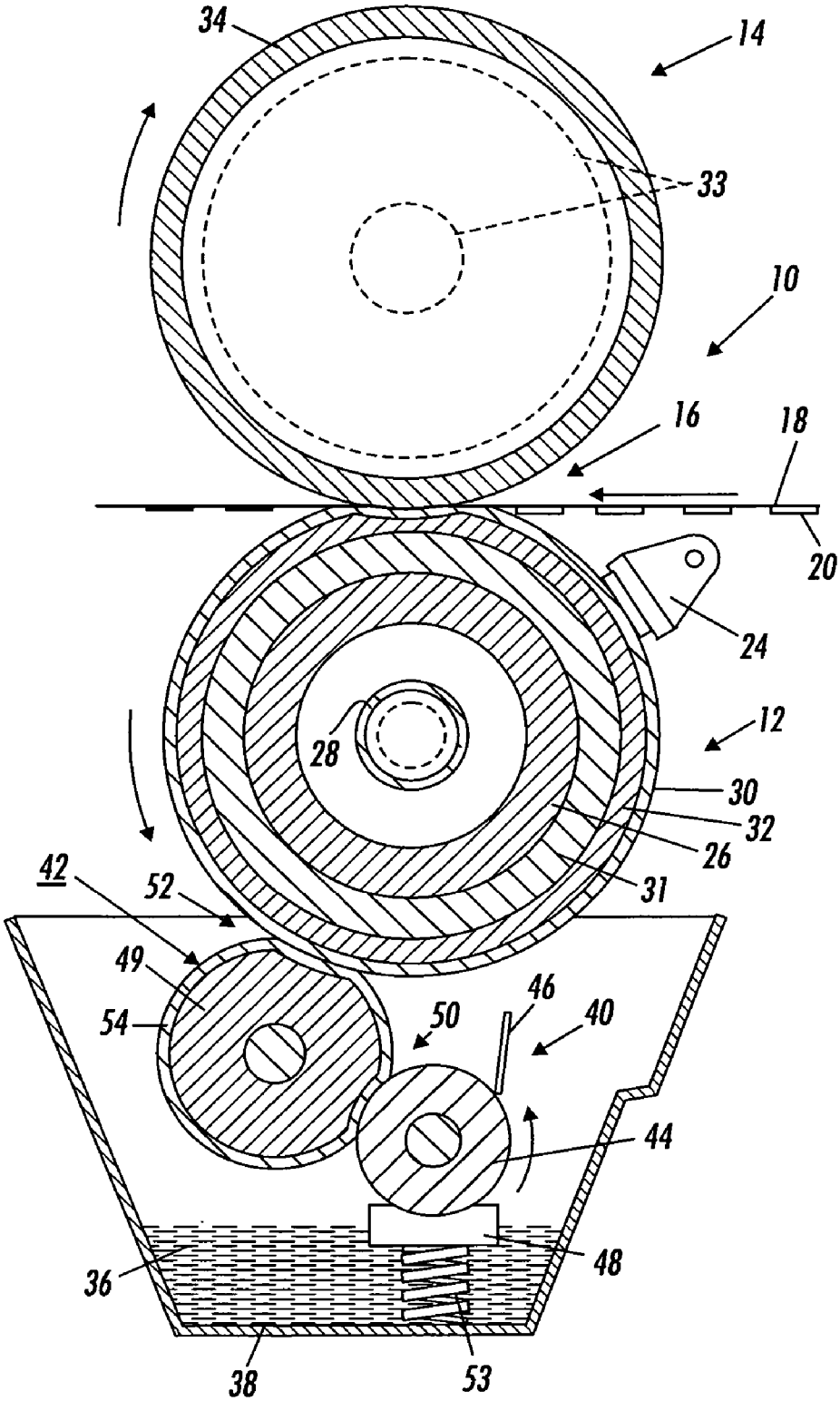
FIG. 1 PRIOR ART
FIG. 1 is a schematic elevation view of a typical prior art fusing apparatus for use in printing machines.

While the disclosure will be described hereinafter in connection with a preferred embodiment thereof, it will be understood that limiting the disclosure to that embodiment is not intended. On the contrary, it is intended to cover all alternatives, modifications and equivalents as may be included within the spirit and scope of the disclosure as defined by the appended claims.

The disclosure will now be described by reference to a preferred embodiment of a fusing apparatus that includes an improved Release Agent Management system.

For a general understanding of the features of the disclosure, reference is made to the drawings. In the drawings, like reference numerals have been used throughout to identify identical elements.

FIG. 1 schematically illustrates a prior art fusing apparatus that includes a multi-layered Nip Forming Fuser Roll (NFFR) structure generally indicated by reference numeral 10. The fuser apparatus comprise a heated roll structure 12 cooperating with a non-heated backup roll structure 14 to form a nip 16 through which a copy substrate 18 passes with toner images 20 formed thereon in a well known manner. The toner images 20 contact the heated roll structure while a force is applied between the roll structures in a well known manner to create pressure therebetween resulting in the deformation of the heated fuser roll structure by the non-heated pressure roll structure to thereby form the nip 16.

As the substrate passes out of the nip, it is generally self-stripping except for a very lightweight one. The substrate requires a guide to lead it away from the fuser roll. After separating from the fuser roll, the substrate is free to move along a predetermined path toward the exit of the printer 8 in which the fuser structure apparatus 10 is to utilized.

A contact temperature sensor 24 is provided for sensing the surface temperature of the roll structure 12 and in conjunction with convention circuitry (not shown) maintains the surface temperature at a predetermined value, for example, on the order of 375°–400° F. The heated roll structure 12 comprises a hollow cylinder or core 26 having a radiant quartz heater 28 disposed in the hollow thereof. Then suitably energized via the aforementioned circuitry, the heating element radiates heat to the cylinder, which is then conducted to the outer surface. The fuser roll is constructed on multiple layers. The first layer attached to the core is generally a conductive silicone rubber having conductivity in the order of 0.4 to 0.7 w/m ° C. In order to prevent penetration of silicone oil into the base layer, two layers of Viton™ are used. A first layer of 40 μm of Viton™ is a thermally conductive Viton™ in the order of 0.25 to 0.4 w/m ° C. The outer layer of 10 μm of Viton™ is relatively non-conductive, smooth-surfaced outer layer 30 of the structure 12. The layer 30 preferably comprises Viton™ (trademark of E. I. Du Pont Nemours & Co. for a fluoroelastomer based on the copolymer of vinylidene fluoride and hexafluoropropylene), which is relatively thin, having a thickness of about 10μ. The conductivity of the outer layer is about 0.17 w/m ° C.

A base layer 31, which is, adhered to the core 26, comprises a relatively thick layer of conductive silicone rubber. A typical thickness for base layer 31 is in the order of 1–3 mm, the conductivity thereof being in the order of 0.5–0.8 w/m ° C. The conductivity of the base member is affected in a conventional manner by adding conductive materials to the silicone rubber. The conductive silicone rubber layer retains sufficient deformability to be used in a NFFR structure notwithstanding the presence of the conductive material.

An inner layer 32 adhered to both the outer layer 30 and inner layer 31 has an intermediate thickness of about 40 μm and like the outer layer 30 is fabricated from Viton™. However, unlike the outer layer 30, the inner layer 32 is rendered thermally conductive using appropriate metallic and/or non-metallic fillers well known in the art to provide a conductivity in the order of 0.25–0.4 w/m ° C. The layers of Viton™ and silicone rubber are fabricated and adhered to each other by various techniques known in the prior art. For example, the Viton™ layers may be formed by spraying or flow coating, while the silicone rubber layer may be molded. The base layer with the outer and inner layers adhered thereto in adhered to the core 26 in any suitable manner. Viton™ is rendered abhesive by the use of appropriate functional silicone oils, such as, Mercapto or amino oils.

The Viton™ outer layer 30 together with the inner Viton™ layer 32 form a barrier layer between the layer 31 and a substrate carrying toner images for preventing oil penetration into the base layer while allowing adequate heat flow therethrough, thereby enabling the NFFR to be utilized for high speed fusing of color toner images.

The outer and inner layers 30 and 32 exhibit good release, durability and produce high gloss toner images with only minimal impedance to heat dissipation compared to prior art devices. The inner conductive layer 32 and the base layer 31 provide for excellent transfer of thermal energy from the heat source 28.

The backup roll structure 14 comprises a metal core 33 to which is adhered a relatively thin layer 34 of a suitable abhesive material. The layer 34 may be provided with a sleeve of suitable material, (not shown). Due to the relative constructions of the heated or fuser roll structure 12 and backup or pressure roll structure 14, the fuser roll is deformed by the harder pressure roll structure when the required pressure is applied therebetween, with the pressure being a function of the desired deformation which corresponds to the desired length of the nip 16.

While outer layer 30 is not adequately abhesive, it has been found desirable to coat this layer with a release agent material 36 contained in a sump 38. The material 36 comprises a polymeric release agent material, such as, Mercapto or amino silicone oil.

For the purpose of coating the heated roll structure 12, there is provided a Release Agent Management (RAM) system generally indicated by reference numeral 40. The mechanism 40 comprises a donor roll 42, metering roll 44, doctor blade 46 and a wick 48, which is urged into intimate engagement with the metering roll 44 by means of a bias spring 53. The metering roll 44 is partially immersed in the release agent material 36 and is supported for rotation such that it is contacted by the donor roll 42 which, in turn, is supported so as to be contacted by the heated roll structure 12. As can be seen, the orientation of the rolls 42 and 44 is such as to provide a path for conveying material 36 from the sump to the surface of the heated roll structure 12. The metering roll is preferably a nickel or chrome plated steel roll having a 4–32 AA finish. The metering roll has an outside diameter of 1.0 inch. As mentioned above, the metering roll is supported for rotation, such rotation being derived by means of the positively driven heated roll structure 12 via the rotatably supported donor roll 42. In order to permit rotation of (at a practical input torque to the heated roll structure 12) the metering roll 44 in this manner, the donor roll 42 comprises a deformable layer 49, which forms a nip 50 between the metering roll and the donor roll. A suitable nip length is about 0.10 inch.

Wick 48 is fully immersed in the release agent and contacts the surface of the metering roll 44. The purpose of the wick is to provide and air seal, which disturbs the air layer, formed at the surface of the roll 44 during rotation thereof. If it were not for the function of the wick, the air layer would be coextensive with the surface of the roll immersed in the release agent thereby precluding contact between the metering roll and the release agent.

The doctor blade 46 preferably fabricated from Viton™ and has a length coextensive with the metering roll. The edge of the blade contacting the metering roll has a radius of 0.001–0.010 inch. The blade functions to meter the release agent picked by the roll 44 to a predetermined thickness, such thickness being of such a magnitude as to result in several microliters of release agent consumption per copy. The donor roll 42 has an outside diameter of 1.0 inch when the metering roll has an outside diameter of 1.0 inch. It will be appreciated that other dimensional combinations will yield satisfactory results.

A thin sleeve 54 on the order of several mils constitutes the outer surface of the roll 42. The sleeve material comprises Teflon, Viton™ or any material that will impede penetration of silicone oil into the silicone rubber. While the donor roll may be employed without the sleeve 54, it has been found that when the sleeve is utilized, the integrity of the donor roll is retained over a longer period and contaminants, such as, lint on the heated roll 12 will not readily transfer to the metering roll, thus reducing the amount of lint traveling into the sump.

Figure 2:
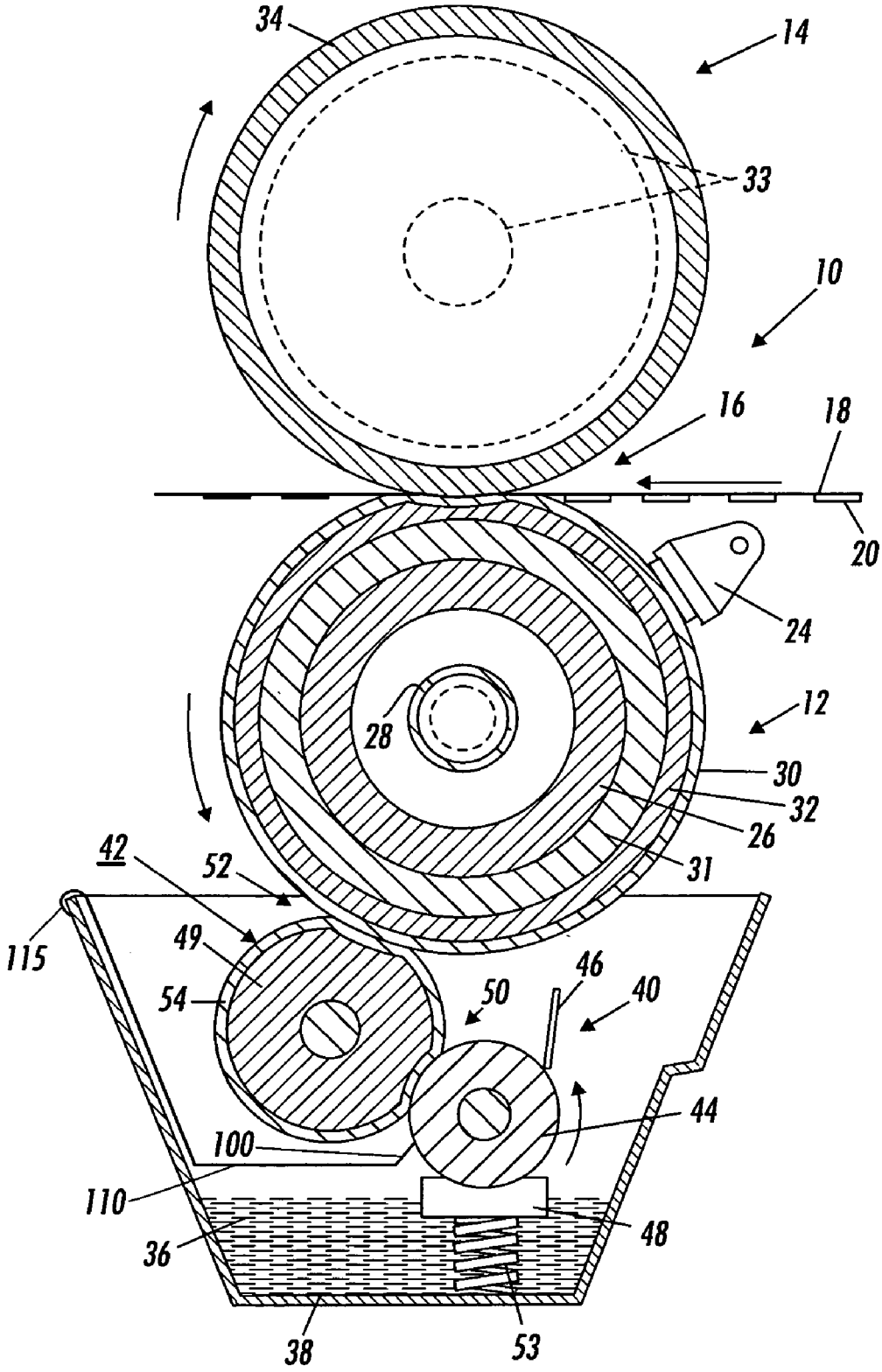
FIG. 2 is a schematic elevation view of a Release Agent Management system for use in the fusing apparatus of FIG. 1 that alleviates contamination of the wick.

An improvement to the RAM system of FIG. 1, as shown in FIG. 2, comprises an additional cleaning blade 100 adapted to scrape the surface of metering roll 44 during the fusing process to remove dirt and debris from the surface or the metering roll. Cleaning blade 100 is connected to a catch or collection tray 110 that traps contaminants removed from the surface of donor roll 44 and prevents them from reaching sump 36 and wick 48, thereby keeping the RAM cleaner longer and reducing streaking and other RAM related copy quality defects and improving release life. Cleaning blade 100 is positioned to contact the surface of metering roll 44 after the metering roll forms a nip 50 with donor roll 42 and before that surface portion of the metering roll that formed the nip reaches release agent material 36 in sump 38. Mounted in this manner, cleaning blade 100 does not interrupt the prime function of the metering roll, while simultaneously, providing the function of scraping contaminants from the surface of metering roll 44 before they reach and plug wick 48.

The disclosed improvement to Release Agent Management system 40 is adapted for retrofitting to existing fuser systems by including a clip 115 that is connected to collection tray 110 and cleaning or scraping blade 100. The clip, collection tray and scraping blade are preferably an integral, single-piece member that fits over one side of sump 38.

Alternatively, cleaning blade 100 could be separate from collection tray 100, if desired. The only critical criteria is that collection tray or collection member 110 be positioned to catch contaminants removed from the surface of metering roll 44 by cleaning blade 100.

It should now be understood that an improvement has been disclosed for Release Agent Management systems that alleviates buildup of dirt, toner and paper debris on the elastomer donor roll, metering roll and blades that includes a blade positioned to scrape the surface of the metering roll before the scraped surface reaches a sump containing a release agent. As a result, degradation of the wick is diminished.

It will be appreciated that various of the above-disclosed and other features and functions, or alternatives thereof, may be desirably combined into many other different systems or applications. Also, that various presently unforeseen or unanticipated alternatives, modifications, variations or improvements therein may be subsequently made by those skilled in the art which are also intended to be encompassed by the following claims.

What is claimed is:

1. An electrophotographic printing machine including a release agent management system, comprising:

a donor member;

a container including a supply of release agent material;

a metering member supported for counter clockwise rotation and in pressure contact with said donor member to form a nip therebetween, said metering member also contacting said supply of release agent material for picking up a quantity of release agent material to be metered;

a metering structure supported in contact with said metering member in a predetermined position between said nip and said quantity of release agent material to meter said quantity of release agent material; and a cleaning member positioned between said nip and said supply of release agent material, and wherein said cleaning member cleans contaminants from the surface of said metering member after said metering member passes said nip and before said metering member contacts said metering structure.

2. The printing machine of claim 1, wherein said cleaning member is a scraping blade positioned after said nip and before said metering structure in order to remove contaminants from the surface of said metering member before the contaminants reach said metering structure.

3. The printing machine of claim 2, including a collection member for collecting said contaminants removed from the surface of said metering member before they reach said container.

4. The printing machine of claim 3, wherein said collection member is connected to said scraping blade.

5. The printing machine of claim 4, including a clip adapted for connection to said container, and wherein said collection member and said scraping blade are connected to said clip.

6. The printing machine of claim 5, wherein said clip, collection member and scraping blade are an integral, single-piece member.

7. The printing machine of claim 6, wherein said release agent material comprises silicone oil.

8. A xerographic device including a heat and pressure fuser, said fuser comprising:

a pair of fuser members between which an imaged substrate passes for fixing of the images thereon;

a release agent management structure including;

a donor member;

a container including a supply of release agent material;

a metering member supported for counter clockwise rotation and in pressure contact with said donor member to form a nip therebetween, said metering member also contacting said supply of release agent material for picking up a quantity of release agent material to be metered;

a metering structure supported in contact with said metering member in a predetermined position between said nip and said quantity of release agent material to be metered to meter said quantity of release agent; and a cleaning member positioned between said nip and said supply of release agent material, and wherein said cleaning member cleans dirt and debris from the surface of said metering member after said metering member passes said nip and before said metering member contacts said metering structure.

9. The xerographic device of claim 8, wherein said cleaning member is a scraping blade.

10. The xerographic device of claim 9, including a collection member.

11. The xerographic device of claim 10, wherein said collection member is connected to said scraping blade.

12. The xerographic device of claim 11, including a clip adapted for connection to said container, and wherein said collection member and said scraping blade are connected to said clip.

13. The xerographic device of claim 12, wherein said clip, collection member and scraping blade are an integral, single-piece member.

14. A method for alleviating the buildup of dirt, toner and debris on a wick in a release agent management system, comprising;

providing a donor member;

providing a container including a supply of release agent material;

providing a metering member supported for counter clockwise rotation and in pressure contact with said donor member to form a nip therebetween, said metering member also contacting said supply of release agent material for picking up a quantity of release agent material to be metered;

providing a metering blade supported in contact with said metering member in a predetermined position between said nip and said quantity of release agent material to be metered; and providing a cleaning member positioned between said nip and said supply of release agent material, and wherein said cleaning member cleans dirt and debris from the surface of said metering roll after said metering member passes said nip and before said metering member contacts said metering structure.

15. The method of claim 14, including providing said cleaning member as a scraping blade.

16. The method of claim 15, including providing a collection member.

17. The method of claim 16, including connecting said collection member to said scraping blade.

18. The method of claim 17, including providing a clip adapted for connection to said container, and wherein said collection member and said scraping blade are connected to said clip.

19. The method of claim 18, including providing said clip, collection member and scraping blade as an integral, single-piece member.

20. The method of claim 19, including providing silicone oil as said release agent material.

* * * * *